US005193897A

United States Patent [19]

Halsey

[11] Patent Number: 5,193,897

[45] Date of Patent: Mar. 16, 1993

[54] COMBINED PEN AND LIGHT POINTER APPARATUS

[76] Inventor: Keith D. Halsey, 2824 Second St., Santa Monica, Calif. 90405

[21] Appl. No.: 817,749

[22] Filed: Jan. 7, 1992

[51] Int. Cl.[5] ..... B43K 29/10

[52] U.S. Cl. ..... 362/118

[58] Field of Search ..... 362/118

[56] References Cited

U.S. PATENT DOCUMENTS

| | | | |
|---|---|---|---|
| 1,610,006 | 12/1926 | Haller | 362/118 |
| 2,811,632 | 10/1957 | Bartlett | 362/118 |
| 2,979,602 | 4/1961 | Barnett | 362/118 |
| 3,963,914 | 6/1976 | Browning et al. | 362/118 |
| 4,028,540 | 6/1977 | Key et al. | 362/118 |

*Primary Examiner*—Carroll B. Dority

[57] ABSTRACT

A combined light pointer and marker comprises a replaceable pen, an energy supply, a light source and an ON/OFF switch. When the light pointer is in use the tip of the pen is covered or retracted. Conversely, when the tip of the pen is exposed, the light source is deactivated. In a preferred embodiment, conductors in a pen cap engage conductors in the pen and light source housing, thereby making energy available in the housing from batteries desirably located in the cap. When the cap is removed to expose the pen tip for writing, the connection between the conductors is broken, battery energy is no longer available in the housing, and depressing the ON/OFF switch cannot activate the light source. This provides an important safety feature.

18 Claims, 1 Drawing Sheet

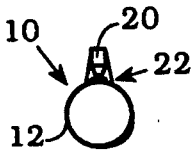
FIG. 1B
PRIOR ART
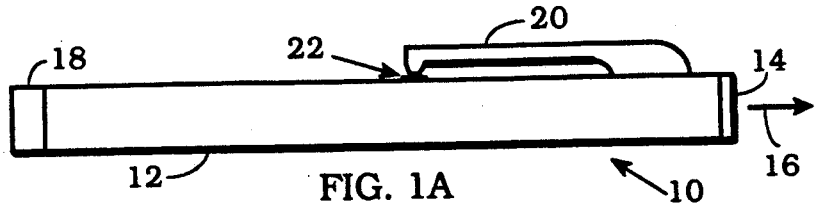
FIG. 1A
PRIOR ART
FIG. 2
PRIOR ART
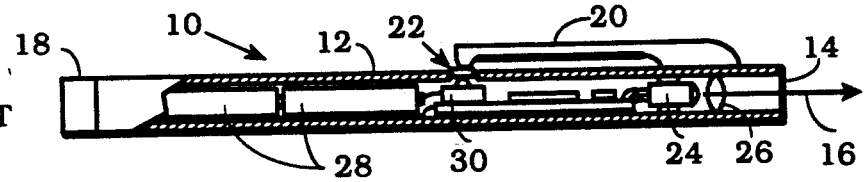
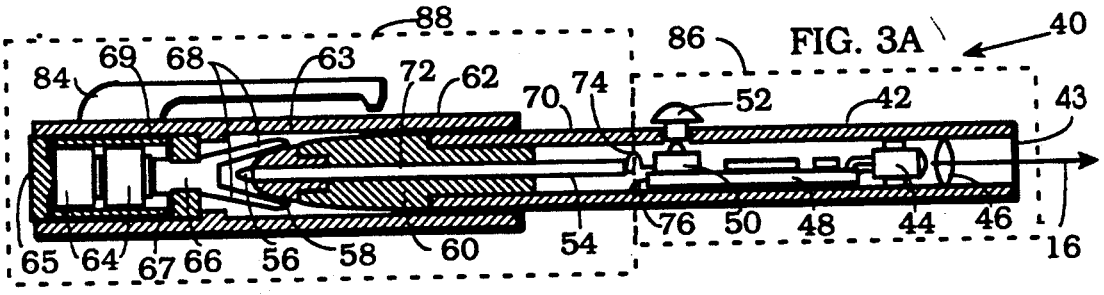
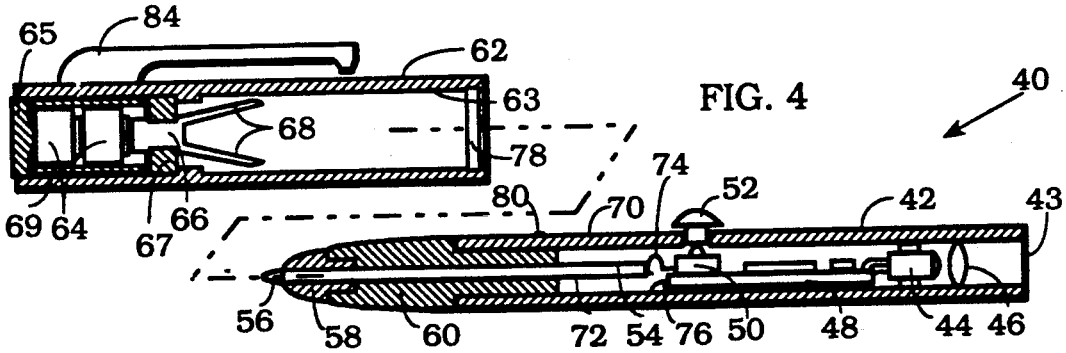
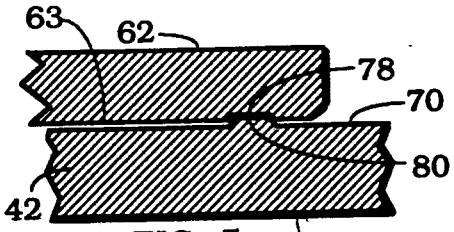
FIG. 5
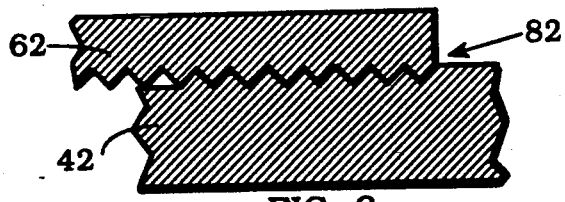
FIG. 6
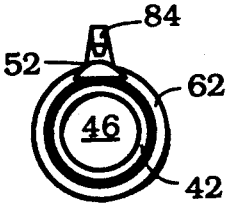
FIG. 3B
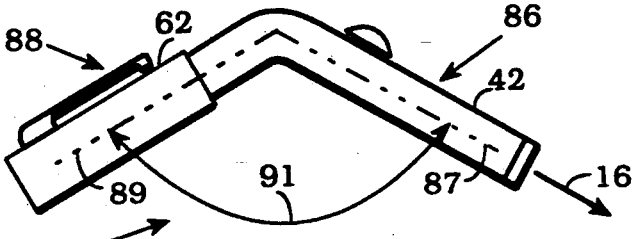
FIG. 7

COMBINED PEN AND LIGHT POINTER APPARATUS

FIELD OF THE INVENTION

The present invention relates to devices useful for both marking and indicating and, more particularly, to a combination writing or marking instrument and light pointer apparatus.

BACKGROUND OF THE INVENTION

Light pointers are commonly used to provide a means for drawing attention to particular locations or items on a display. The display may be any form of visual media, as for example but not limited to, a photo or drawing or picture or painting or mural or projected slide or motion picture or video display or combination thereof or other media conveying visual information to the human eye or to a camera or detector of any type. Light pointers typically function as indicators by projecting a distinctive spot of light onto the material being displayed. Lasers are commonly used as light sources for such optical pointers.

Laser light pointers are known in the art. The Laser Powerpointer TM manufactured by Lyte Optronics, Inc. of Santa Monica, CA 90405 is an example of a state-of-the-art optical pointer utilizing an optical diode laser as the light source. It has an tubular shape about 8.5 mm in diameter by about 13 cm in length with a diode laser generated light beam projected from one end when a switch on the side is depressed.

While this and other light pointers are very useful, they are limited in function. For example, no light indicator or pointer is known to exist which also provides a writing or marking function in the same unit. This and other deficiencies of present day light pointers are overcome by the arrangement of the present invention.

As used herein the word "pen", whether singular or plural, is intended to refer to any means for writing or drawing or marking. Non-limiting examples are: nib or ball or felt (or other porous) tip pens or markers using liquid or paste or dry inks, and erodible chalk, pencil, crayon, charcoal or other markers, and scratching or etching or engraving tools, and/or combinations thereof. As used herein the words "marking" and "writing" are intended to including marking, writing, printing, drawing and any other form of notation produced by a marker or pen and the word "marker" is intended to include the word "pen".

SUMMARY OF THE INVENTION

There is provided a light pointer and marking apparatus comprising in combination, a replaceable pen, an energy source, a laser diode or other light source, and a switch mounted in a housing, wherein the switch controllably couples energy from the energy source to the laser diode to produce a light beam for laser light pointing.

In a preferred embodiment the housing has first and second portions moveable with respect to each other, and an interruptible electrical connection between the energy source and the laser diode so that relative motion of the first and second portions uncovers the pen for writing or marking and interrupts the interruptible electrical connection to prevent coupling of the energy source to the laser diode while writing or marking. It is desirable that the pen and laser diode be located in the first portion of the housing and the energy source be located in the second portion of the housing and that the two portions be separable. In a preferred embodiment, the interruptible electrical connection is provided where the first and second portions join and separate. Batteries are a convenient energy source.

Decoupling the energy source from the light source when the pen is uncovered prevents accidental activation of the light source when the pen is in use. This is a highly desirable safety feature in connection with laser light pointers.

BRIEF DESCRIPTION OF THE DRAWINGS

FIG. 1A is a simplified side view and FIG. 1B a simplified left end view of a light pointer according to the prior art;

FIG. 2 is a simplified partial cut-away and cross-sectional view of the light pointer of FIGS. 1A–B;

FIG. 3A is a simplified partial cut-away and cross-sectional view of engaged body and cap portions of a combined light pointer and marking pen apparatus according to a preferred embodiment of the present invention and FIG. 3B is a right end view of the apparatus of FIG. 3A;

FIG. 4 is a simplified partial cut-away and cross-sectional view of a preferred embodiment of the present invention according to FIG. 3A, but with the body and cap portions disengaged;

FIGS. 5 and 6 are simplified cross-sectional views of portions of the apparatus of FIGS. 3A–4, somewhat enlarged and showing additional details of how the cap band body engage, according to different embodiments; and FIG. 7 is simplified partial side view of a combination light pointer and marker apparatus according to further embodiments of the present invention.

DETAILED DESCRIPTION OF THE DRAWINGS

FIG. 1A is a simplified side view and FIG. 1B a simplified left end view of light pointer 10 according to the prior art. Light pointer 10 comprises substantially cylindrical body 12 having open end 14 from which light beam 16 is emitted and removable end cap 18 through which batteries are inserted. Pocket clip 20 is conveniently arranged to so as to depress microswitch actuator 22 to turn light beam 16 ON or OFF.

FIG. 2 is a simplified partial cut-away and cross-sectional side view of the light pointer of FIGS. 1A–B. Light pointer 10 has internal to housing 12, laser diode 24 and lense 26 for forming collimated light beam 16. Electrical energy to excite laser diode 24 is derived from batteries by way of microswitch 20 and control circuit 32. Control circuit 32 regulates the current supplied to laser diode 24 by batteries 28. Control circuit 32 may be a simple resistor or a more complex constant current regulator. Such arrangements are well known in the art. Depressing pocket clip 20 pushes down microswitch actuator 22, thereby closing microswitch 30 and causing current to flow from batteries 28 to laser diode 24 through control circuit 32 to produce light beam 16.

While light pointer 10 is useful it has limited functionality, being suitable only as a light pointer, there are many occasions when it is desirable to also have the capability to mark or write in connection with the display or slides being illustrated by use of the light pointer. For example, when the light pointer is being used in conjunction with transparencies shown by means of an overhead projector there is often a need to mark on the transparencies during the course of a presentation to add to or modify or high-light data or illustrations contained therein. In other instances, the presenter may find it necessary to make notes on comments received from his or her audience during the course of a presentation. Since present day light pointers have no marking or writing capability, they are not useful for this purpose and must be set aside while a suitable marking or writing pen is used to alter the transparency or other material being projected or record the desired notes.

The present invention overcomes this another limitations of current light pointers by providing an integral marking or writing pen built into a light pen. In a preferred embodiment, the present invention arranges the pen and light pointer so that accidental actuation the light pointer during use of the pen is precluded. This is an important safety feature since present day light pointers may, through use of laser diodes or other high intensity light sources, produce light beams of sufficient energy density to be hazardous to the unprotected eye.

FIG. 3A is a simplified partial cut-away and cross-sectional side view of combined light pointer and marking pen apparatus 40 according to a preferred embodiment of the present invention when arranged so as to permit actuation of the light source, and FIG. 4 is a similar view of the same apparatus 40 when arranged so as to permit use of the writing pen and preclude actuation of the light source. FIG. 3B is a view looking toward the right end of FIG. 3A, that is, toward the end from which light beam 16 emerges. The construction and features of apparatus 40 are conveniently explained by considering FIGS. 3A and 4 together.

The present invention combines pen 54, light source 44, switch 50 and energy source 64 in common assembly 40. In the preferred embodiment, assembly 40 has two portions, housing 42 containing the light source 44 and pen 54, and cap 62 which acts as a covering for pen tip 56 and as an electrical interlock to prevent actuation of light source 44 when pen tip 56 is uncovered.

In the preferred embodiemnt, housing 42 contains light source 44, lense 46, control circuit 48, switch 50, switch actuator 52, and pen 54 having protruding writing tip 56. Pen 54 is desirably held in place in housing 42 by conductive bushing 58 and dielectric bushing 60. Bushings 58, 60, housing 42 and pen 54 may be press-fit together or screwed together or snapped together or a combination thereof, in much the same way as is common with ordinary pen housings, depending upon the particular type of pen desired to be used. The construction and function of light source 44, lense 46, control circuit 48, switch 50 and switch actuator 52 are analogous to similar items 24, 26, 32, 30 and 22 described in connection with FIGS. 1A–2, and those of skill in the art will understand how to construct such items to provide the particular light intensity desired for the light pointer function. When light source 44 is actuated, light beam 16 is emitted from end 43 of housing 42.

Cap 62 acts as a pen cover and electrical interlock allowing operation of light source 44 when cap 62 covers pen tip 56 and engages housing 42 (see FIG. 3A) and preventing operation of light source 44 when cap 62 is disengaged from housing 42 to expose pen tip 56 (see FIG. 4). In the preferred embodiment illustrated in FIGS. 3A–4, cap portion 62 of apparatus 40 comprises batteries 64 one pole of which is electrically coupled to conductive battery loading plug 65 and the other pole of which is electrically coupled to central contact 66 spaced from shell 63 of housing 62 by insulating bushing 67. Central contact 66 has extended fingers 68 which make contact with conductive bushing 58 of housing 42 when housing 42 and cap 62 are engaged (see FIG. 3A), and which are disconnected from conductive bushing 58 when housing 42 and cap 62 are disengaged (see FIG. 4). Batteries 64 are desirably separated from shell 63 of cap 62 by insulating sleeve or coating 69. Batteries 64 are desirably of the familiar "button" type used in watches, hearing aids, cameras and other miniature electronic devices, but this is not essential.

When cap 62 and housing 42 are engaged, energy from one pole of batteries 64 flows along conductive shell 63 of cap 62 to conductive shell 70 of housing 42 and energy from the other pole of batteries 64 flows through central contact 66 and fingers 68 of cap 62 to central bushing 58 of housing 42. Thus, electrical energy is delivered to housing 42, only when cap 62 is engaged thereon. Conductive bushing 58 is insulated from shell 70 by insulating bushing 60.

Where pen 54 has a metallic barrel 72 it conducts electrical energy from bushing 58 to spring contact 74 leading to switch 50 and control circuit 48. When barrel 72 is not metallic or only partially metallic, then a conductive strap or wire (not shown) is placed alongside or in parallel with barrel 72 to provide continuity from bushing 58 to switch 50. Wire or strap 76 conveniently connects conductive shell 70 of housing 72 to circuit 48 so as to complete the other connection between batteries 64 and circuit 48. When cap 62 is engaged on housing 42, light source 44 is activated by depressing microswitch 50 via switch button 52. Light beam 16 is then emitted from apparatus 40.

During operation of apparatus 40 as light pointer, cap 62 is in place over pen tip 56. Conversely, when pen tip 56 is exposed for use in writing or marking, light source 44 cannot be actuated. This prevents accidental turning ON of light source 44 while writing with apparatus 40. This is an important safety feature, since in normal use, light source 44 is facing toward the operator when pen 54 is being used for writing or marking in the arrangement of FIGS. 3A–4.

Groove 78 is conveniently provided in shell 70 of cap 62 which mates with boss 80 provided on shell 70 of housing 42. This provides a snap-together action for engaging cap 62 and housing 42. This feature is illustrated in FIG. 4 and in more detail in FIG. 5. However, other means for joining cap 62 and housing 42 will also serve. Use of screw threads 83 is illustrated in FIG. 6 for joining cap 62 and housing 42. Those of skill in the art will understand based on the description herein that any convenient arrangement may be used for temporarily reatining cap 62 on housing 42.

While cap 62 is shown in FIG. 4 as being removable, this is not essential. All that is required is that assembly 40 have two portions possesing relative motion such that when one portion is moved with respect to the other so as to expose pen tip 56, an electrical connection between the energy source and the light source is interrupted. For example, a single housing may be used containing the battery, pen, light source and control switch with the pen tip located under a movable (e.g., rotating or sliding) cover whose motion is coupled to an interruptible conductor. Sliding or rotating the cover away from the pen tip or moving the pen itself simultaneously moves the interruptible conductor so as to interrupt it and break a circuit coupling the energy source to the light source or light source switch. For example, a push-rod or lever causing the pen tip to be exposed, such as is used in conventional retractable ball point pens, is arranged to force apart two leaf type electrical contacts when it is depressed to expose the pen tip, thereby interrupting an electrical connection between the battery and light source control circuit or switch. Based on the description herein, those of skill in the art will understand how this may be accomplished without undue experimentation.

Pocket clip 84 is conveniently provided on cap 62, but this is not essential. Clip 84 can be omitted or provided on housing 42 or both.

Referring now to FIG. 3A, dashed outline 86 denotes that portion of apparatus 40 having the light source and control circuitry (and optionally, the control switch). Similarly, dashed outline 88 denotes that portion of apparatus 40 having the pen and safety interlock preventing actuation of the light source when the pen is exposed for writing. While in the preferred embodiment, as for example shown in FIGS. 3A–4, portions 86 and 88 are arranged along a common axis, this is not essential. For example, FIG. 7 illustrated modified assembly 40' of the present invention wherein portions 86 and 88, having axes 87 and 89 respectively, are oriented at angle 91 with respect to each other. Angle 91 can have any value from approximately 0° (portions 86 and 88 folded substantially parallel to each other) to 180° (portions 86 and 88 oriented along a common axis as shown in FIGS. 3A–4), depending upon the arrangement desired by the user. This is accomplished, for example, by extending connections 74 and 76 to accommodate the desired angle and providing the desired bend in housing 42. Housing 42 may be one-piece or multi-piece to facilitate construction.

For convenience of explanation, the present invention has been described in terms of an embodiment in which there is no energy source in the housing containing the light source, rather the energy source is contained in the removable cap. While this arrangement is particularly simple and preferred, it is not essential. Other arrangements will also provide the desired electrical interlock function to prevent the light source from being energized when the pen is being used. For example, the energy source may be located anywhere within apparatus 40, e.g., in housing 42, and the connections provided by fingers 68 and/or shell 63 used merely to complete a circuit leading up to switch 50. Another alternative is to have the cap contain no conductors, but include a protrusion that allows or forces two internal contacts within housing 42 to meet when cap 62 is engaged on housing 42, thereby completing the circuit between the energy source and switch 50, and releases them when removed. However, such arrangement are more susceptible to an accidental completion of the circuit and energizing the light source even though the cap is not engaged since the energy source is within the housing containing the light source. This possibility is avoided by having the energy source detached when the cap is removed as illustrated in the embodiment of FIGS. 3A–4. This is a particular feature of the present invention.

Another advantage of placing the energy source, e.g., the batteries, in the cap rather than the light source and pen portion of the housing is that the overall dimensions of the apparatus may be made smaller then would otherwise be the case. When the pen is incorporated in the light pointer, elongated batteries (e.g., type AAA) such as are used in the prior art light pointer of FIGS. 1A–2 are more difficult to accommodate since they may make the light pointer/pen inconveniently long. Similarly, placing flat button type batteries of equivalent capacity in the light pointer/pen housing portion of the apparatus can result in an undesirably "fat" pen, i.e., one that is uncomfortable to hold. These difficulties are overcome by placing the batteries in the cap. The cap has a larger diameter since it is intended to slip over the light source/pen housing, hence larger diameter and larger capacity batteries can be readily accommodated. Further, with the preferred arrangement, the cap is removed during writing and so does not lead to a "fat", uncomfortable, writing tool.

For convenience of explanation, the apparatus of the present invention has been described for the situation where the energy source is a battery or multiple batteries. While this arrangement is particularly convenient, it is not essential. For example, the batteries of FIGS. 3A–4 can be replaced by a power cord running to an external power supply. The functioning of the apparatus is otherwise the same.

Further, while the ON/OFF switch is described as being located in the housing containing the pen and the light source, this is not essential. The ON/OFF switch for controlling the light source can be located either in the light source housing or the cap or, as an additional precaution, two switches can be provided, one in each part that must be depressed together or in a particular sequence. Those of skill in the art will understand based on the description herein how to implement such variations without undue experimentation.

While the present invention has been described in terms of laser diode light sources, those of skill in the art will understand based on the description herein that any reasonably high intensity light source can also be employed, as for example and not limited to, hot filament lamps, gas discharge lamps, florescent lamps, laser diodes, gas lasers, chemical lasers, arcs, and combinations thereof, and as used herein, the words "light source" are intended to include these and such other variations as will occur to those of skill in the art. The more readily the light from the light source can be focussed into a narrow parallel (non-diverging) beam, the more useful for pointing purposes.

Having described the invention, those of skill in the art will understand that it solves the problem of providing a combined light pointer and writing tool in a particularly convenient and safe way. Having the energy source disconnected by removal of the pen cap precludes accidental discharge of the light source while writing or marking. Locating the batteries in the cap not only provides an especially safe arrangement for a combined marker-light pen, but also permits larger capacity batteries to be accommodated so that a powerful light pointer is obtained without any significant increase in the diameter of the pen portion of the housing. Thus, an uncomfortably "fat" pen is avoided while still obtaining a powerful combination light pointer and pen.

A combination pen and light pointer was constructed approximately as shown in FIGS. 3A–4 using a conventional laser diode as the light source, a control circuit and microswitch similar to that employed in the prior art, three button type batteries having an outer diameter of about 11 mm, and a conventional roller-ball pen refill cartridge with a metal casing. Housing 42 and 62 were of metal (e.g., anodized aluminum or brass). Delrin TM or Mylar TM was used for the various insulating bushings, washers or sleeves. The light pointer/pen portion of the housing was substantially cylindrical and about 10 mm in outer diameter. The cap was also substantially cylindrical and about 14 mm in outer diameter. The cap slipped over the pointer/pen portion of the housing substantially as illustrated in FIGS. 3A-4. The overall length of the unit with the cap in place on the pen/-pointer housing was about 14 cm, only slightly larger than prior art units. Microswitch button 52 was partially recessed into the sidewall of housing 42 so as to be less susceptible to being bumped and causing unintended actuation of the light source. The unit provided a powerful light pointer in a small form factor with a readily accessible, safe to use, integral marking pen.

Based on the teachings herein, those of skill in the art may make many variations hereon which do not depart from the spirit and content of the present invention. Accordingly, it is intended to include the foregoing and other variations as fall within the scope of the claims that follow.

I claim:

1. A combination light pointer and marker apparatus comprising, a first portion having therein a light source for forming an indicating light beam projecting from a first part of the first portion and a pen with a marking end projecting from a second part of the first portion, and a second portion removably covering the marking end of the pen, wherein the second portion comprises interlock circuit means for preventing actuation of the light source when the second portion is removed from the first portion and enabling actuation of the light source when the second portion covers the marking end of the pen.

2. The apparatus of claim 1 wherein the light source is energized by an energy source in the second portion.

3. The apparatus of claim 1 further comprising, connection means for completing part of a circuit between an energy source and the light source when the second portion and the first portion are engaged and preventing such when disengaged.

4. The apparatus of claim 3 wherein the second portion is adapted to retain the energy source and the connection means comprises an electrical connection means making contact with conductors contained in the first portion.

5. The apparatus of claim 4 wherein the energy source comprises one or more batteries held in the second portion.

6. The apparatus of claim 1 wherein the first portion contains no energy source for powering the light source.

7. The apparatus of claim 1 wherein the second portion contains a battery for powering the light source.

8. The apparatus of claim 1 wherein the first and second portions have elongated shapes with the pen and light beam being located approximately at opposed ends of the elongated first portion and wherein, when the first and second portions are engaged, the second portion covers an otherwise exposed part of the pen.

9. The apparatus of claim 1 wherein the first portion has at least first and second electrical leads whose connection to a power source is needed to energize the light source, wherein the first lead is exposed on an exterior surface of the first portion and the second lead is exposed adjacent the marking end of the pen.

10. The apparatus of claim 9 wherein the second portion comprises electrically conductive connection means for electrically coupling a battery in the second portion to the first and second electrical leads.

11. The apparatus of claim 1 wherein the second portion is adapted to retain at least one battery and wherein a first pole of the battery is coupled to a first conductor of the second portion and a second pole of the battery is coupled to a second conductor of the second portion insulated from the first conductor.

12. The apparatus of claim 11 wherein, when the first and second portions are joined, the first conductor is coupled to a third conductor included in the first portion and the second conductor is coupled to a fourth conductor included in the first portion, wherein electrical energy from the battery is able to pass along the first and second conductors to the third and fourth conductors when the first and second portions are engaged to cover the pen.

13. A combination light pointer and marker apparatus comprising, a first portion having therein a light source for forming an indicating light beam projecting from a first part of the first portion and a pen with a marking end projecting from a second part of the first portion, and a second portion adapted to removably cover the marking end of the pen such that removal of the second portion from the first portion prevents activation of the light source;

wherein the second portion is adapted to retain at least one battery and wherein a first pole of the battery is coupled to a first conductor of the second portion and a second pole of the battery is coupled to a second conductor of the second portion insulated from the first conductor;

wherein, when the first and second portions are joined, the first conductor is coupled to a third conductor included in the first portion and the second conductor is coupled to a fourth conductor included in the first portion, wherein electrical energy from the battery is able to pass along the first and second conductors to the third and fourth conductors when the first and second portions are engaged; and further comprising electrical switch means for completing a circuit between the third conductor and the fourth conductor and the light source to actuate the light source.

14. An apparatus for providing a light beam and a marking means, comprising:

a pen and a light source for projecting the light beam, the pen and light source being contained in a common housing;

a cover means removably coupled to the housing for covering a marking end of the pen; and an electrical interlock circuit means interruptably coupling an energy supply and the light source, wherein the interlock circuit means is activated by the cover means so that when the cover means is engaged on the housing over the pen the light source may be activated and when the cover is removed from the housing to expose the pen the light source may not be activated.

15. The apparatus of claim 14, wherein the light source and pen are arranged so that part of the pen projects from a first end of the housing and the light beam projects from a distal second end of the housing.

16. The apparatus of claim 15 further comprising switch means interposed between the energy supply and the light source for controllably coupling the energy supply to the light source to produce the light beam.

17. A light pointer and marking apparatus comprising in combination, a replaceable pen supported by a housing, a removable cap for covering the pen, a terminal means for connection to an energy source, a laser diode, a switch coupled to the housing, and circuit means comprising an interlock actuated by the removable cap, wherein the circuit means interruptably couples the terminal means, the laser diode and the switch through the interlock means, wherein the switch controllably couples energy from the terminal means to the laser diode to produce a light beam for laser light pointing only when the removable cap covers the pen and not otherwise.

18. The apparatus of claim 17 a wherein the pen and laser diode are located in a first portion of the housing and the terminal mean are located in a second portion of the housing separable from the first portion of the housing.

* * * * *